United States Patent [19]

Bourgein et al.

[11] 4,423,552

[45] Jan. 3, 1984

[54] UNIVERSAL KNIFE BLOCK

[76] Inventors: John Bourgein; Betsy Rothman, both of 4549 Horton St., Oakland, Calif. 94608

[21] Appl. No.: 378,760

[22] Filed: May 17, 1982

[51] Int. Cl.[3] ..... A47F 5/16

[52] U.S. Cl. ..... 30/296 A; 248/37.3

[58] Field of Search ..... 30/296 A, 296 R; 211/60 T; 248/37.3, 37.6

[56] References Cited

U.S. PATENT DOCUMENTS 2,357,646 9/1944 Gilbert ..... 30/296 A 2,753,631 7/1956 Culver ..... 30/296 A 3,677,400 7/1972 Spier ..... 248/37.3

4,305,511 12/1981 Denholtz ..... 248/37.3

*Primary Examiner*—Jimmy C. Peters

*Attorney, Agent, or Firm*—H. Michael Brucker

[57] ABSTRACT

An improved knife block for storing and protecting cutlery wherein the knife pockets provided for receiving knife blades are formed by removable members which can be located in a variety of locations to form knife pockets of the required size for the particular cutlery to be stored and protected.

10 Claims, 9 Drawing Figures

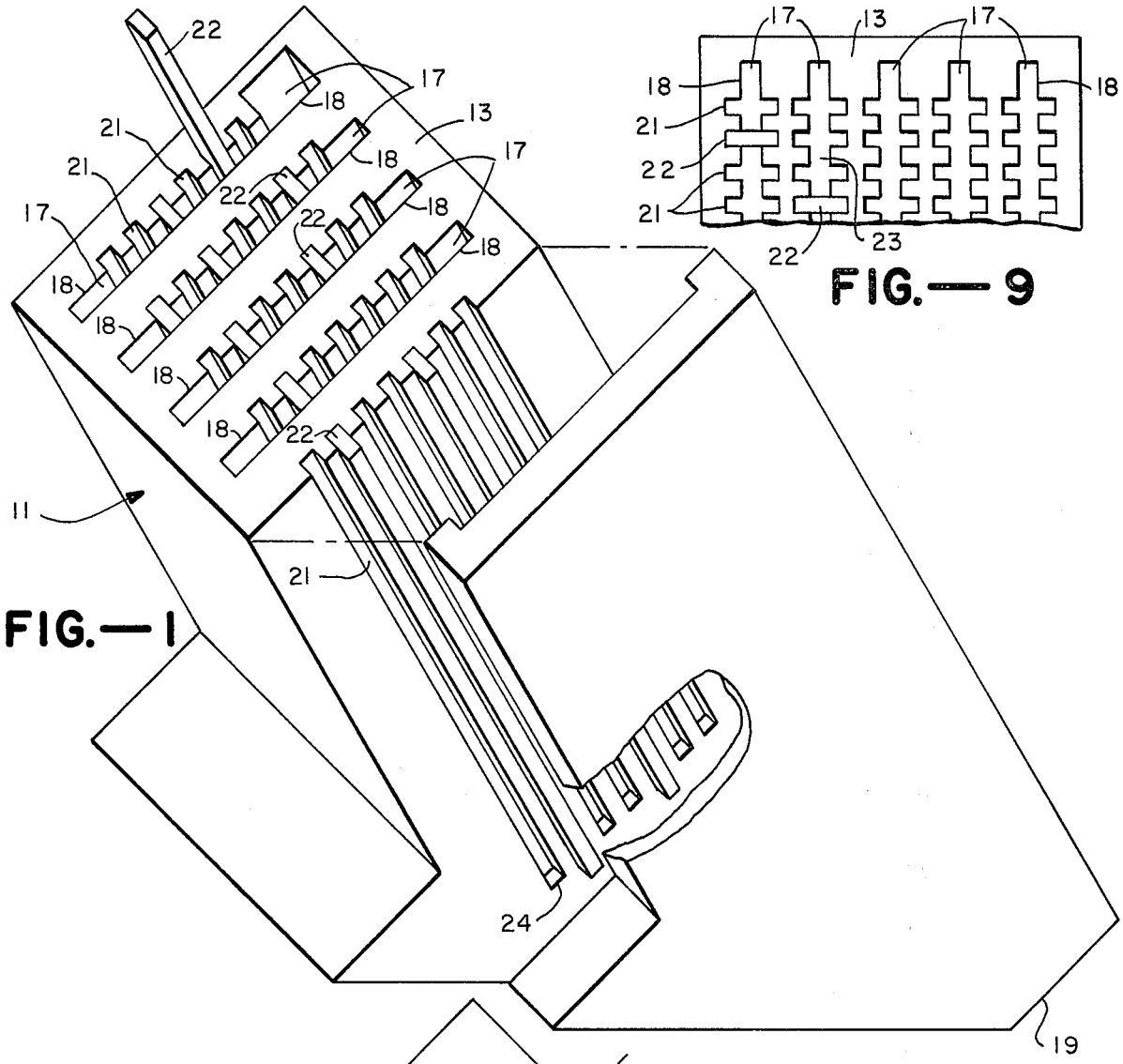
FIG.—1
FIG.—9
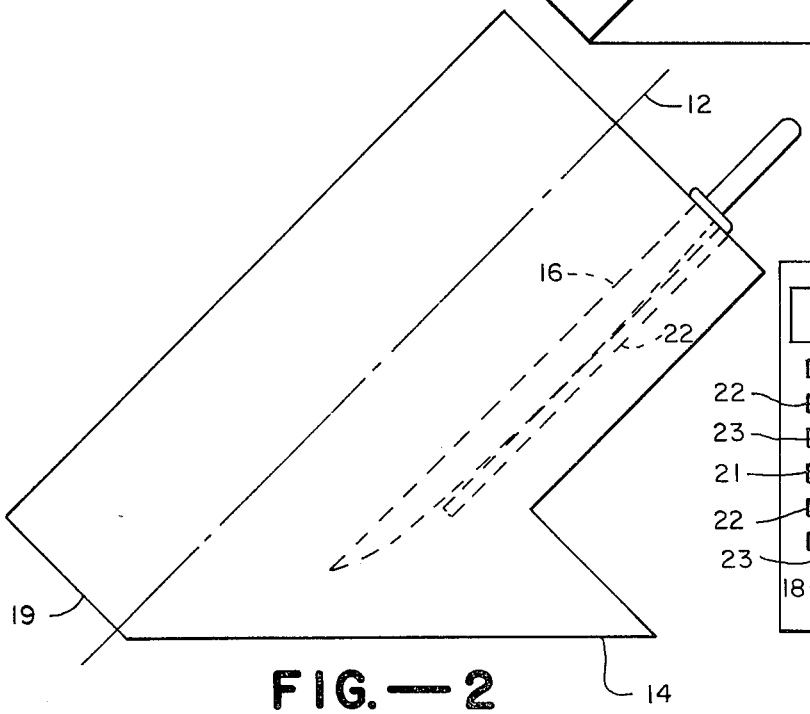
FIG.—2
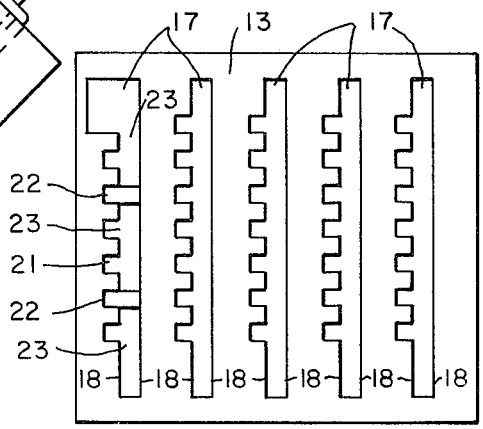
FIG.—3

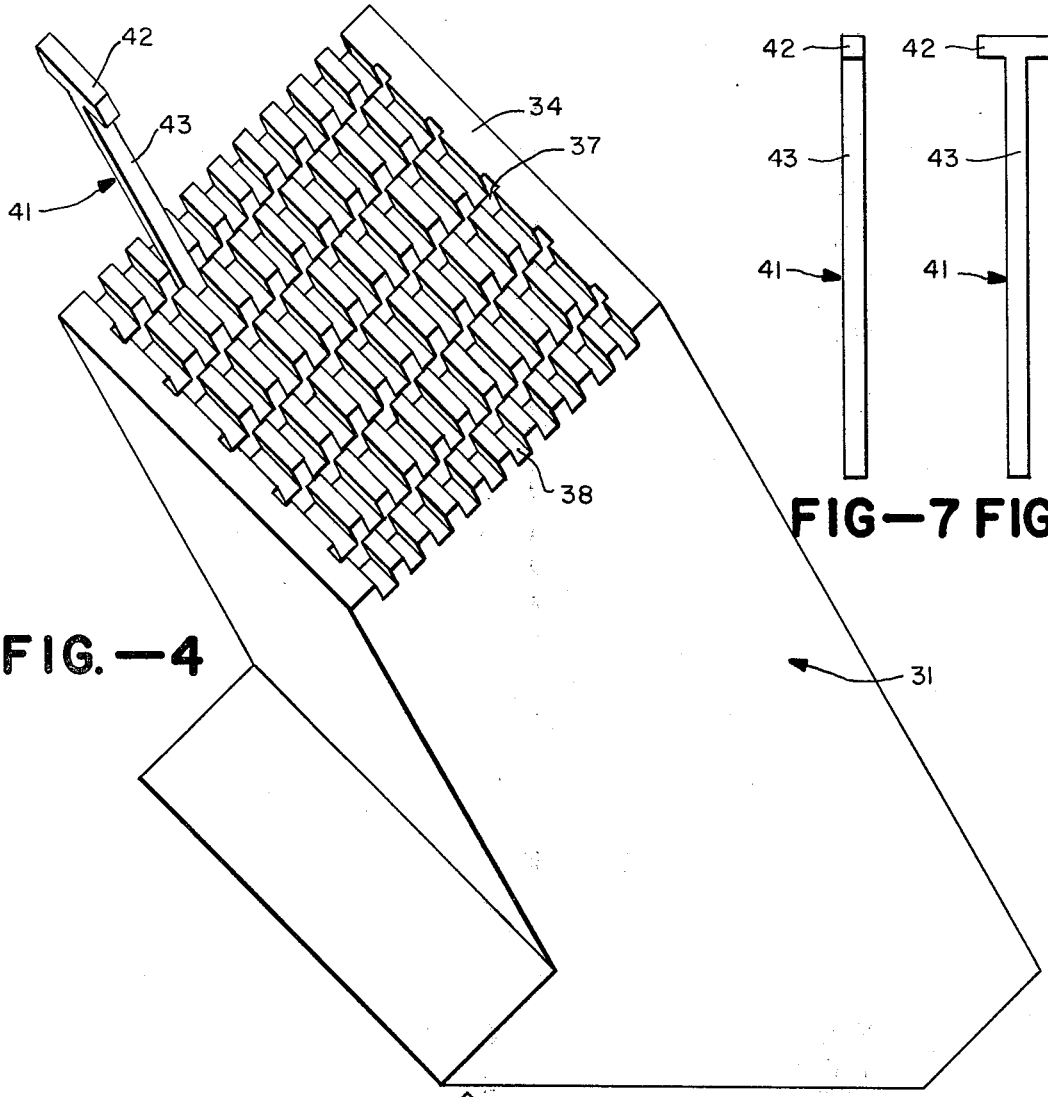
FIG.—4
FIG—7 FIG.—8
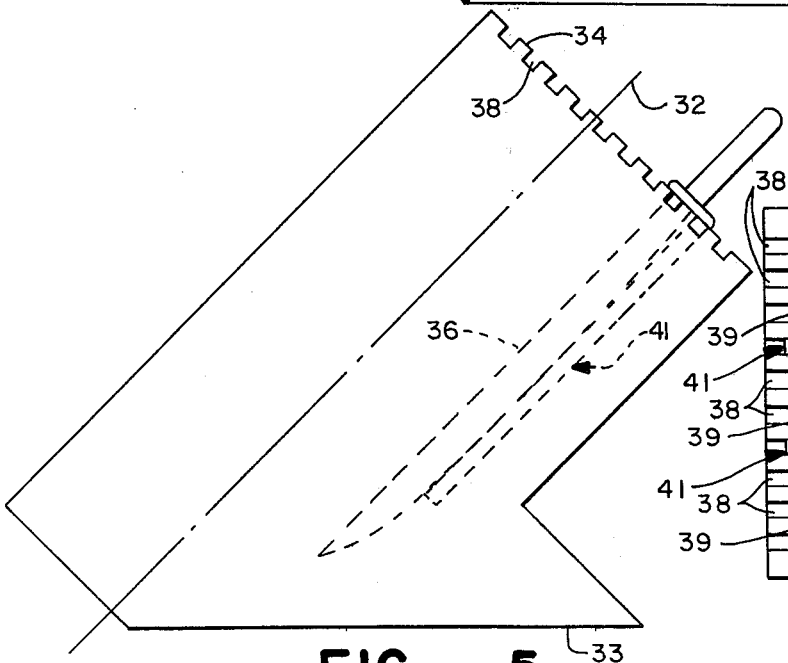
FIG.—5
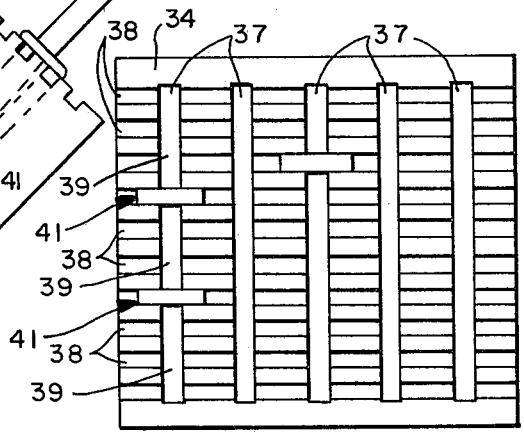
FIG.—6

UNIVERSAL KNIFE BLOCK

BACKGROUND OF THE INVENTION

Knife blocks for holding and protecting cutlery are generally characterized by a substantially solid block of material, normally wood, which has a number of parallel spaced slots which extend from one face of the block deep into its interior and in some cases all the way through to the opposing surface. These slots are permanently subdivided into knife pockets where the subdivisions are selected to produce knife pockets having a variety of different sized openings to accommodate knife blades of different widths. Since the subdivision of the knife block slots are permanent, it is more often the case than not, that the knife block is provided with knife pockets which do not precisely match the size of the cutlery owned by the purchaser of the block. The present invention is a knife block provided with means for adjusting the dimensions of the knife pockets by providing moveable subdivision members to enable the purchaser of the knife block to subdivide the slots to precisely match the cutlery to be stored and protected in the block.

BRIEF DESCRIPTION OF THE DRAWINGS

FIG. 1 is a perspective representation of a knife block constituting one embodiment of the invention with a section exploded and partially cut away to expose the interior of one of the slots.

FIG. 2 is a side elevation of FIG. 1.

FIG. 3 is a plan view of the knife block face into which cutlery is inserted.

FIG. 4 is a perspective representation of a knife block constituting a second embodiment of the invention.

FIG. 5 is a side elevation of FIG. 4.

FIG. 6 is a plan view of the face of the block of FIG. 4.

FIG. 7 is a side elevation of a member which subdivides the slots of the knife block.

FIG. 8 is a front elevation of FIG. 7.

FIG. 9 is a plan view of the face of an alternative embodiment.

DETAILED DESCRIPTION OF THE ILLUSTRATED EMBODIMENTS

Referring to FIGS. 1, 2 and 3 one embodiment of the present invention comprises a generally solid block member 11 having a longitudinal axis 12 and defined by a plurality of exterior planes including a face plane 13 and base plane 14. The present invention is equally applicable to verticle knife blocks as well as slant knife blocks. The embodiments of FIGS. 1, 2 and 3 is that of a slant knife block whereby the angle between the base plane 14 and the longitudinal axis 12 is greater than 30 degrees and less than 60 degrees.

When the embodiment of the present invention is in a slant knife block such as that illustrated, it is necessary to provide means for maintaining a knife such as knife 16 generally parallel to the longitudinal axis 12 of the knife block since if unrestrained the forces of gravity would tend to rotate the knife towards a more vertical orientation.

A plurality of elongated slots 17 for storing and protecting knife blades are formed in the block 11 and are defined by a pair of substantially parallel closely spaced side walls 18 which extend from the face of block 11 generally parallel to the longitudinal axis 12 all the way to the base plane 14 and end plane 19 so that the slots 17 extend all the way through the knife block. Although the embodiment illustrated does depict the slots 17 as extending all the way through the knife block, it is only necessary that the slots extend substantially into the knife block and a distance greater than the length of the longest blade which the block is designed to store and protect.

One wall 18 of each slot 17 has formed therein a plurality of spaced divider grooves 21 which extend from the face plane 13 and which in the embodiment of FIG. 1 extend generally parallel to the longitudinal axis 12 a substantial distance. While the grooves need not extend a distance equal to the longest knife blade for which the block is designed, it is preferable that they extend a distance equal to a significant fraction of the longest blade to be stored. All of the divider grooves 21 extend into the knife block the same distance. Referring to FIG. 9, an alternative embodiment, has divider grooves 21 formed in both walls 18 to form opposing groove pairs.

Slot dividers 22 are provided for the purpose of subdividing the slots 17 into individual knife pockets 23. Slot dividers 22 are formed to fit into divider grooves 21 so as to slidably insertable and removable therefrom. Each slot divider is dimensioned to span the distance between walls 18 of a groove 17 and to extend from the face plane 13 to the bottom 24 of groove 21. By the selection of the divider grooves 21 which receive slot dividers 22 the slots 17 are subdivided into knife pockets 23 having a slot length suitable for the particular cutlery to be stored and protected in the knife block. By virtue of the fact that the slot dividers 22 extend a substantial distance into the block 11 and are held at an angle substantially parallel to the longitudinal axis 12 by the registry of the slot dividers in the divider groove 21 a knife such as knife 16 when inserted in a knife pocket is held substantially parallel to the longitudinal axis 12 and prevented from rotating downward by the effects of gravity. In this way, knives which are retained in the same groove 17 are prevented from contacting each other and their sharpened edges contact only the slot dividers 22 which are formed of a material such as wood which will not dull or damage the edge of a knife blade.

Thus, from the foregoing it can be seen that the knife block of the present invention is capable of providing a wide variety of different size knife pockets and can thus be tailored precisely for a given set of cutlery as opposed to knife blocks now known in the art which require that the cutlery be matched to the knife block.

Referring now to FIGS. 4, 5, 6, 7 and 8 a knife block 31 is substantially similar to the knife block 11 in that it includes a longitudinal axis 32 which forms an angle with the base 33 of more than 30 degrees and less than 60 degrees, has a face plane 34 into which a knife 36 can be inserted through slots 37. Slots 37 are generally parallel to longitudinal axis 32 and extend a substantial distance into the block 31 if not all the way there through. A plurality of shallow recesses 38 are formed in the face of block 31 transversely to the slots 37 whereby a pair of recesses 38 extend transversely from slot 37 at a plurality of locations along the slot's dimension in the face 34. Thus unlike the embodiment of FIG. 1, the divider grooves of the embodiment of FIGS. 4–8 comprise the recesses 38 which extend only a small distance into the block from the face plane 34.

The slots 37 are subdivided into individual knife pockets 39 by slot dividers 41 which include a top member 42 and a longitudinal member 43 which are connected to form a generally T-shaped member. When a slot divider 41 is inserted into a slot 37 top member 42 registers with recesses 38 and is dimensioned such that when top member 42 is seated in recesses 38 the top of member 42 resides in the face plane 34.

The slots 37 are thus subdividable into knife pockets 39 having dimensions in the face plane 34 dependent upon the particular recesses 38 into which slot dividers 41 are inserted. The registry of top members 42 in recesses 38 maintain the longitudinal members 41 at an angle generally parallel to the longitudinal axis 32 thus preventing the knife blade of knife 36, for example, from rotating in a more vertical direction in response to gravity. Thus, while the recesses 38 are shallow as opposed to the extended lengths of the slot grooves 21 of FIGS. 1, 2 and 3 in both instances the same result is achieved in that the pocket forming members are secured substantially parallel to the longitudinal axis of the block and maintain a knife blade at substantially the same angle and divided from and protected against blades located in the same slot.

In the embodiment of FIGS. 1, 2 and 3, the depth of the grooves 21 in the block 11 are all identical as are the lengths of the slot dividers 22 whereby any slot divider 22 will work in any slot 21. It is important that the length of slot divider 22 be such that the divider does not extend into the slot a distance which prevents its easy retrieval and it is equally important that it does not, when in place, extend above the face plane 13 where it would prevent the easy insertion and removal of cutlery.

In the embodiment of FIGS. 4–8, the position of the top member 42 is determined by its registry with slots 38 and thus it is not absolutely necessary for the longitudinal members 41 of dividers 43 to be precisely the same length in order to be capable of subdividing any of the slots at any of the recessed locations.

It will be appreciated while particular embodiments of the invention have been shown and described, modifications may be made. It is intended in the following claims to cover all such modifications which come within the spirit and the scope of the invention.

What is claimed is:

1. A knife holder comprising a generally solid block member defined by exterior planes including a face plane and having a longitudinal axis perpendicular to said face plane wherein said block has formed therein a plurality of elongated slots for storing and protecting knife blades wherein each said slot is defined by a separate pair of substantially parallel closely spaced side walls extending a substantial distance into said block member parallel to said longitudinal axis wherein each of said slot defining walls has an edge in said face plane whereby a knife blade can be inserted into said block member through one of said slots in said face plane thereof A plurality of spaced divider grooves formed in at least one side wall of each of said slots and wherein each said divider groove has an edge in said face plane A plurality of slot dividers, each formed to be slidably insertable into and removable from a slot at a selected divider groove, each of said dividers having a width that spans the distance between the walls defining a slot and a length which permits each said divider to extend from said face plane into said block a substantial distance, said divider including a portion which registers in a divider groove when said divider is inserted into said block at a divider groove whereby each of said slots is divisible into a plurality of knife blade storing and protecting pockets wherein the number of said pockets formed from each slot and the size knife blade which can be inserted into a pocket is determined by the particular divider grooves into which dividers are inserted.

2. The knife holder of claim 1 wherein the longitudinal axis of said block member when said block member is free-standing on a horizontal surface forms an angle of more than 30 degrees but less than 60 degrees with the horizontal surface.

3. The knife holder of claim 2 wherein said divider grooves extend a substantial distance from said face plane into said block.

4. The knife holder of claim 3 wherein all of said divider grooves extend into said block from said face plane the same distance and all of said slot dividers are of equal length and approximately the same length as said divider grooves.

5. The holder of claim 4 wherein said slots extend into said block from said face plane a greater distance than said divider grooves.

6. The knife holder of claim 2 wherein the portion of said slot divider that registers with said divider groove maintains said divider approximately parallel to said longitudinal axis of said block.

7. The knife holder of claim 2 wherein said divider grooves are defined by shallow recesses in said face plane extending transverse to said slots.

8. The knife holder of claim 7 wherein said slot dividers are further defined as having an end member which registers with a recess when said divider is inserted into a slot adjacent a divider groove whereby said divider is maintained at an angle generally parallel to said longitudinal axis.

9. The knife holder of claim 7 wherein each of said recesses extends from each side of a slot at a divider groove location and said divider end member forms a "T" with the rest of said divider.

10. The knife holder of claim 1 wherein said divider grooves are further defined as extending from said face plane a substantial distance into said block member and formed in both side walls of said slots in opposing relationship to form groove pairs that extend transversely to said slot.

* * * * *